United States Patent [19]

Richter

[11] Patent Number: 4,950,106

[45] Date of Patent: Aug. 21, 1990

[54] METHOD AND APPARATUS FOR INSTALLATION OF AN UNDERGROUND SEAL BENEATH A GARBAGE DUMP

[76] Inventor: Hans Richter, Ortlerstrasse 77, D-8900 Augsburg, Fed. Rep. of Germany

[21] Appl. No.: 347,779

[22] PCT Filed: Aug. 12, 1988

[86] PCT No.: PCT/EP88/00721

§ 371 Date: Apr. 27, 1989

§ 102(e) Date: Apr. 27, 1989

[87] PCT Pub. No.: WO89/02009

PCT Pub. Date: Mar. 9, 1989

[30] Foreign Application Priority Data

Aug. 27, 1987 [DE] Fed. Rep. of Germany ..... 3728569

[51] Int. Cl.[5] ..... B09B 1/00

[52] U.S. Cl. ..... 405/128; 405/138; 405/270

[58] Field of Search ..... 405/129, 128, 270, 35, 405/53, 146, 141, 138, 52

[56] References Cited

U.S. PATENT DOCUMENTS 4,636,112 1/1987 Raviv ..... 405/270 X

FOREIGN PATENT DOCUMENTS 3519124 12/1986 Fed. Rep. of Germany ..... 405/128

3605062 4/1987 Fed. Rep. of Germany ..... 405/128

WO86/07107 12/1986 PCT Int'l Appl. ..... 405/128

*Primary Examiner*—Dennis L. Taylor

*Attorney, Agent, or Firm*—Antonelli, Terry, Stout & Kraus

[57] ABSTRACT

A method and apparatus for installing an underground seal beneath a garbage dump in a strip-like manner. The earth is worked in strips under the garbage dump by the front end of a driving shield. The earth is transported to the rear end of the driving shield, and is compressed at the rear end. A strip-like layer of a waterproof material is inserted, under the protection of a cover of the driving shield. A supply tunnel pipe is constructed and subsequently dismantled, comprised of individual tunnel pipe sections, under the protection of the cover while the driving shield is moved forward. The dismantled tunnel pipe sections of the tunnel pipe are used to erect an additional tunnel pipe which is laterally displaced in a direction toward the next strip-like layer opposite the first one tunnel pipe behind the driving shield. By stabilizing the dismantled pipe sections they need not be dragged along or transported out of the remaining tunnel pipe.

19 Claims, 3 Drawing Sheets

METHOD AND APPARATUS FOR INSTALLATION OF AN UNDERGROUND SEAL BENEATH A GARBAGE DUMP

FIELD OF THE INVENTION

This invention relates to a method for the installation of an underground seal beneath a garbage dump by means of a driving shield forced under the garbage dump, and a device for carrying out the method.

DESCRIPTION OF PRIOR ART

A method of this type is the subject of European patent document No. EP-A 0,230,667. According to this method, two parallel trenches are dug along opposite edges of the dump, the depth of the trenches corresponding to the depth at which the dump is to be underrun. A driving shield then is forced under the dump from one trench to the other, earth being worked at its front side. Earth is filled in at the back of the driving shield and a strip of a sealing layer is thereby inserted. A power supply to and from the driving shield is run via a tunnel pipe which was erected during the underrunning of the garbage dump and which pipe is made up of individual tunnel pipe sections. When the driving shield has reached the other trench, it is turned by 180° and runs under the dump in the direction of the first trench, whereby an adjacent strip of a sealing layer is inserted and, at the same time, the previously assembled tunnel pipe is dismantled. After the first trench is reached, the driving shield is again turned by 180° and runs under the dump, as described above, in direction of the second trench whereby a tunnel pipe is laid anew.

A disadvantage of that method is that when the tunnel pipe is dismantled as the driving shield proceeds from the second trench to the first, the dismantled tunnel pipe sections must either be dragged along by the driving shield or transported via the remaining piece of tunnel pipe.

SUMMARY OF THE INVENTION

An object of the present invention is to improve the method in such a way that dismantling the tunnel pipe does not cause the aforenoted disadvantage.

The object is attained in accordance with the invention in which an embodiment is a method for installing an underground seal beneath a garbage dump in a strip-like manner, progressively working the earth in strips under the garbage dump with the front end of a driving shield, transporting the earth to the rear end of the driving shield, compressing the earth at said rear end, inserting a strip-like layer of a waterproof material under the protection of a cover of the driving shield, constructing and subsequently dismantling a supply tunnel pipe comprised of individual tunnel pipe sections under the protection of the cover while the driving shield is moved forward, and using the dismantled tunnel pipe sections of the one tunnel pipe to erect an additional tunnel pipe which is laterally displaced in direction toward the next strip-like layer opposite said one tunnel pipe behind the driving shield.

Another embodiment is an apparatus for installing an underground seal beneath a garbage dump comprising a driving shield for progressively working the earth under the garbage dump in adjacent strips including apparatus for transporting the worked earth to the rear end of the driving shield, apparatus for compressing the transported earth at said rear end, a cover for the driving shield, apparatus for laying a strip-like layer of a waterproof material under the protection of the cover prior to disposing worked earth thereover, a first tunnel pipe comprised of individual pipe sections located beside the driving shield, and means for dismantling the pipe sections progressively and constructing an additional pipe, using the dismantled pipe, laterally displaced from the first tunnel pipe behind the first tunnel pipe.

BRIEF INTRODUCTION TO THE DRAWINGS

Embodiments of the invention are described in greater detail below, with reference to the drawings, in which.

DESCRIPTION OF AN EMBODIMENT OF THE INVENTION

Figure 1:
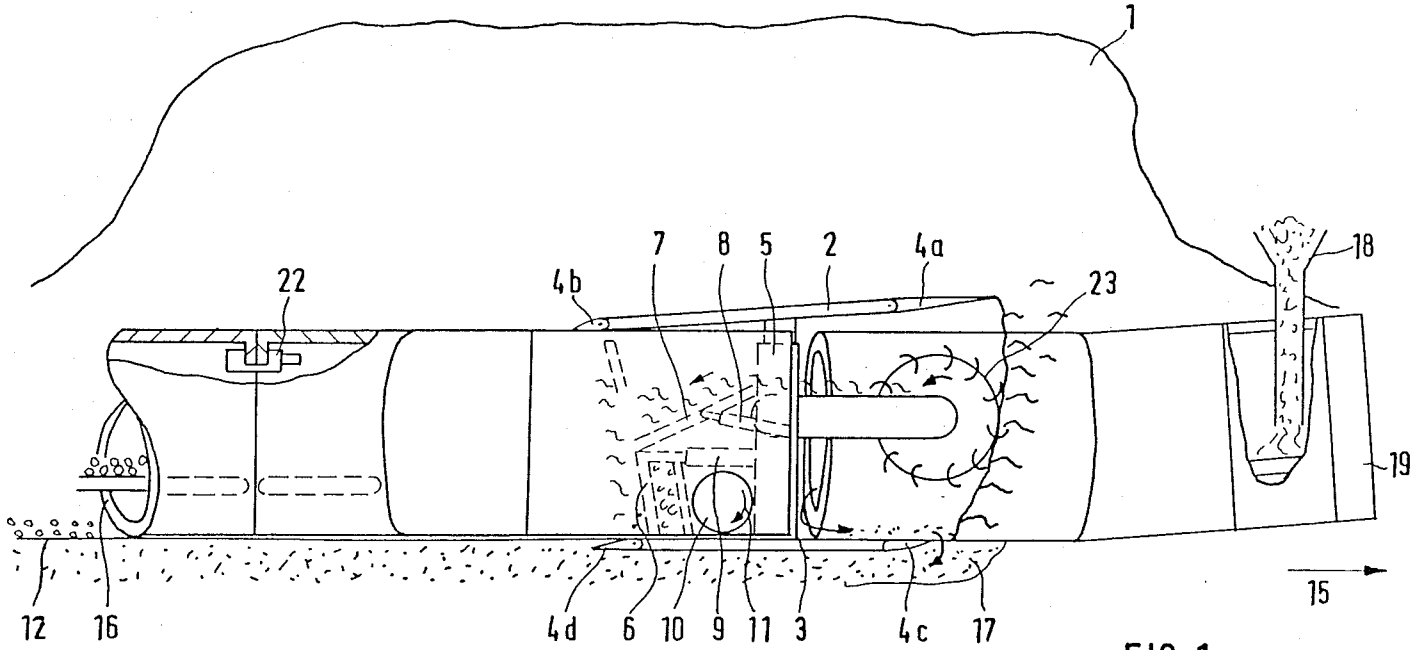
FIG. 1 illustrates a vertical section through a garbage dump and an embodiment of the device of the invention.

A tunnel pipe is laid at the foot of the dump in a trench along which, at the side facing dump, a feed press moves. The feed press picks up the earth at the front and compresses it at the back. A waterproof layer is continuously inserted as strips at the back of the feed press pipe sections of the tunnel pipe are continuously dismantled as the press advances, and after having been laterally displaced, are assembled again to form a new tunnel pipe. The driving shield can have a foil roll which unwinds continuously due to the feed motion of the shield in such a way that the foil comes to rest underneath the dump. Also continuously with the feed motion, the foil is welded with the edge of the previously laid foil. The device is turned by 180° at the end of the dump, so that it can insert and weld the next foil sheet in the same manner beneath the dump.

At least some of the Pipe sections of the tunnel pipe have inclined end profiles, to make it possible to bend the tunnel pipe by radially turning it. In this way, a sealing underlayer can be inserted under the dump forming a tublike structure once the edges of the underlayer are pulled up to the surface of the earth.

A personnel and/or material pressure sluice, as well as an inflow funnel for mineral sealing materials, which can be inserted above and below the foil, can be disposed at each end of the tunnel pipe. The power supply for the conveyors and the driving shield follow along the tunnel pipe.

In order to prevent ground water from possibly entering the partially open driving shield, the tunnel pipe can be filled with compressed air. Ventilation takes place via pressure pipes.

The driving shield is comprised of a base plate and a cover overlapping it, which are connected with hydraulic cylinders. The hydraulic cylinders are moved more or less quickly when the driving shield advances into the ground in order to reduce the top pressure. A horizontal feed press is located at the back end above the unwinding foil, the earth worked in front of the driving shield being filled and compressed behind the open top of the feed press. The shield of the rear feed press is duplicated, so that filter material (gravel) to be placed on the foil surface can be inserted. The gravel is conveyed in through the rear tunnel pipe. Loam to be placed below the foil is conveyed in along the front tunnel pipe. Rerouting of these materials from the conveyer belt to the installation sites takes place via pipes, baffles, etc.

The cover and base plate of the driving shield have movable blade shields at the front and back ends, which enable a horizontal control. Vertical control is effected by loading the horizontal feed press and a hydraulic cylinder, which is supported on the rear tunnel pipe, in an appropriately different manner.

A further feature of the method is that the individual tunnel pipe sections have a horizontal separation joint, so that the element halves can be conveyed along the tunnel pipe and be installed or disassembled in the driving shield when displaced longitudinally.

The individual tunnel pipe sections can be connected to one another so as to be watertight by means of automatically operated hydraulic quick-action vises.

The driving shield, comprised of a cover plate 2 and a bottom plate 3, which are connected to one another via vertical hydraulic cylinders 5, is located beneath the dump 1. Blade shields **4*a*, 4*b*, 4*c* and 4*d*, pinned to plates 2 and 3 so as to be rotatable about a horizontal axis, are disposed at the front and back of plates 2 and 3 respectively. A rear feed press 6 has an upper, horizontally hinged plate 7. Plate 7 is operated by a hydraulic cylinder 8. Forward thrust is provided by means of press 6 upon operation of operating hydraulic cylinder 9. Roll of foil 10 turns in direction of arrow 11, so that the unrolled foil 12 comes to lie below the dump 1. At 13, foil sheet 12 is welded or otherwise adhered together with foil sheet 14, which was laid in a previous step. The driving shield moves in the direction of arrow 15**.

On conveyor belt 16, drainage filter material (gravel) to be placed on top of the foil is brought in through the rear tunnel pipe, and loam 17 to be placed below the foil is brought in through the front tunnel pipe. The loam as well as the gravel is inserted, in each case, via a funnel 18 onto the conveyor belt in the tunnel pipes. The personnel sluice 19 at the end and beginning of the tunnel pipes seals these hermetically. The tunnel pipe sections 20 are alternately diagonally separated and connected via hydraulic quick-action vises 22. A clearing device 23 works the earth. The worked material is transported along the direction of arrow 24 behind the rear feed press 6 and its plate 7.

The tunnel pipe section 25 is moved along the direction of arrow 26 to the right and is connected there with tunnel pipe section 28 by means of hydraulic clamping devices 22. 25' represents a displaced ring 25. Hydraulic cylinder 27 is retained on ring 28. Reference numeral 29 designates the horizontal dividing lines of the piPe sections for separating them into two half shells. Reference numeral 29' designates the displacement of dividing line 29 in order to attain a bend of the tunnel pipe shown in FIG. 1. Reference numeral 30 represents the foil welding device.

The method is carried out as follows.

Figure 2:
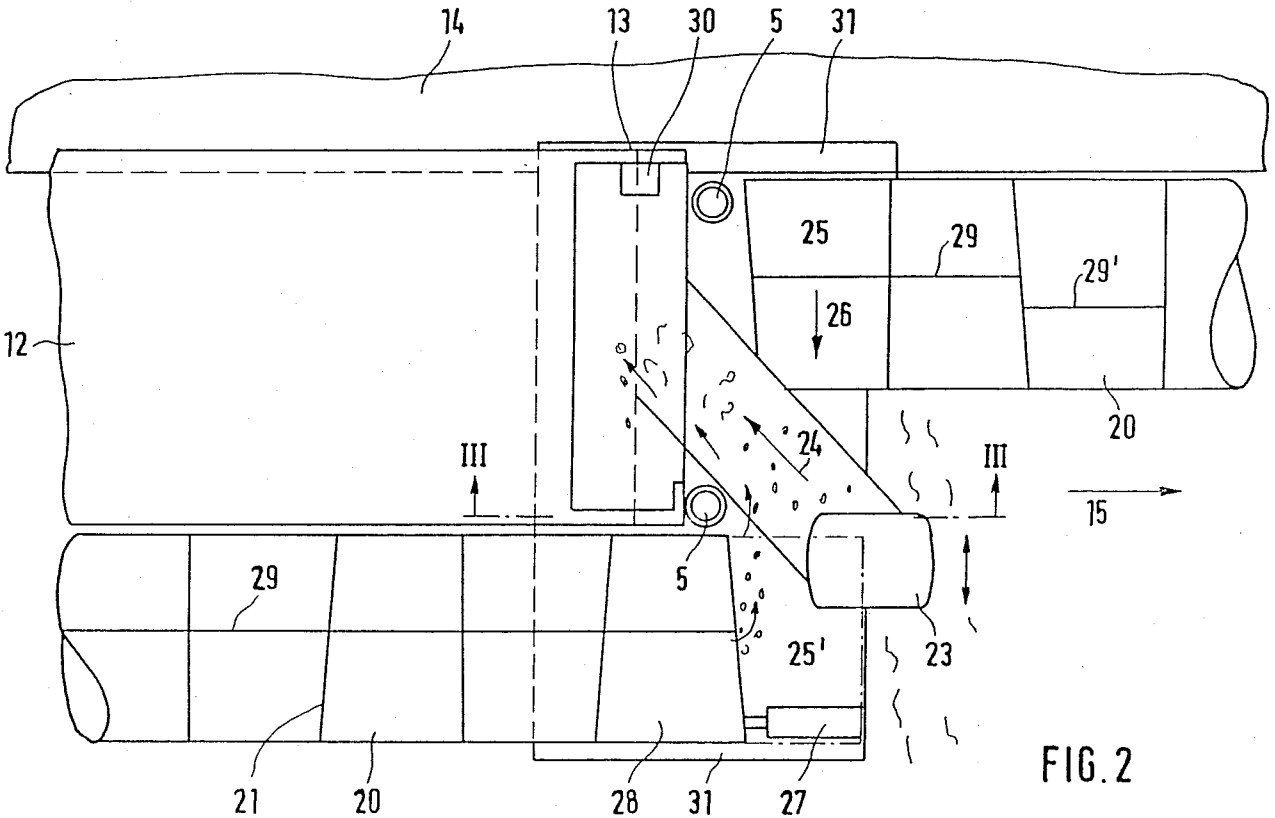
FIG. 2 illustrates a horizontal section through the garbage dump and the device of the invention.
Figure 3:
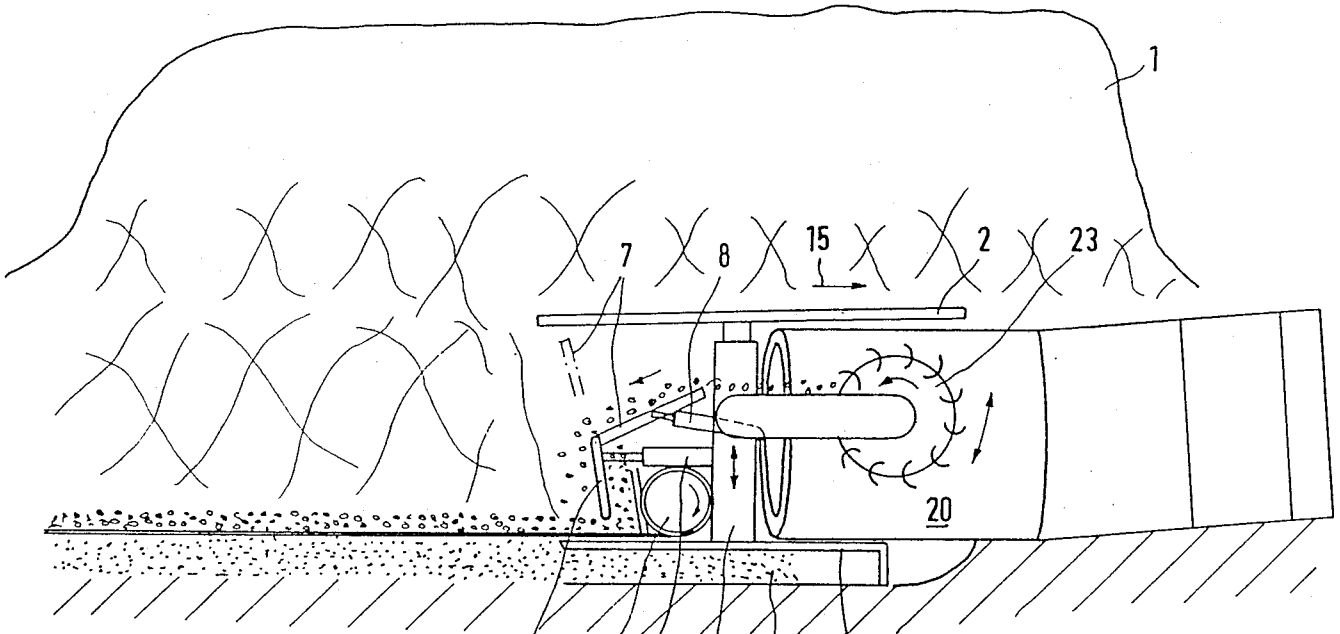
FIG. 3 is a further section along the line III—III of FIG. 2.

First of all, a tunnel pipe, consisting of the tunnel pipe sections 20, is laid along the dump in a trench, for example, the tunnel pipe at the upper portion of FIG. 2. The driving shield is then attached to this tunnel pipe, pointing in the direction of the dump, and a part of the foil 12 is thereby pulled off roll 10. Gravel is applied to this part of the foil 12.

The earth beside the tunnel pipe is then worked by a clearing device 23. For this purpose, the clearing device 23 can be moved horizontally and vertically between the plates 2 and 3. The worked earth reaches plate 7 via a conveyer belt in the direction of arrow 24 and onto the gravel layer disposed on the foil 12 behind press 6.

At the front end of the base plate 3, a loam layer 17 is inserted at the bottom in place of the earth which has been removed from there. Cylinder 8 is then actuated, as a result of which plate 7 swings upwardly, as well as the cylinders 9 of press 6, as a result of which plate 7 and press 6 pack the ground behind the device and whereby the driving shield is shifted in direction of arrow 15. Additional foil 12 is thereby unwound from roll 10.

The last tunnel pipe section 20 between plates 2, 3 is then moved in direction of arrow 26 to form a further tunnel pipe, the tunnel pipe shown at the lower portion of FIG. 2.

This procedure now repeats itself, i.e. applying gravel onto the additionally unwound foil 12, working the earth beside the one tunnel pipe in front of the driving shield, transporting this earth behind the driving shield beside the further tunnel pipe, inserting the loam layer in front of the driving shield and beside the one tunnel pipe, compressing the worked earth behind the driving shield beside the further tunnel pipe while simultaneously advancing the driving shield and dismantling the last tunnel pipe section from the one tunnel pipe and attaching it to the next tunnel pipe.

In this way, a tunnel pipe is continuously dismantled and another tunnel pipe is, at the same time, built. A loam layer is inserted, a foil layer is laid on the loam layer when this other tunnel pipe is dismantled and the next tunnel pipe is laid, gravel is applied to the foil layer and the worked earth is packed over the gravel layer.

When the worked earth is packed behind the driving shield, the driving shield can pull itself forward on the one tunnel pipe by means of hydraulic drives and maintain itself on the other tunnel pipe by means of hydraulic cylinder 27, which improves the feed motion in direction of arrow 15.

The gravel can be delivered via the one tunnel pipe, whereas the loam is delivered via the other tunnel pipe. Cleared earth can also be removed via one of the two tunnel pipes, which is necessary when the cleared earth cannot be adequately compressed behind the driving shield.

A piping system for drawing off seepage water can be laid together with the gravel layer on foil 12. This piping system is connected to a pumping station and a treatment station, whereby seepage water is chemically treated in the treatment station. It is then again conducted to the surface of the dump in order to wash out destructive materials.

Since each of the tunnel pipe sections 20 has a front side 21 which extends alternatively vertically or diagonally to the pipe axis, it is possible to bend the tunnel Pipe by turning the tunnel pipe ring 20 about its axis, as is shown on the right side in FIG. 1.

The cover 2 of the driving shield is preferably distinctly larger than the base plate 3. In order to prevent the earth from falling in on the side, the driving shield has laterally movable shields 31.

I claim:

1. A method for installing an underground seal beneath a garbage dump in a strip-like manner, comprising progressively working the earth in strips under the garbage dump at the front end of a driving shield, transporting the earth to the rear end of the driving shield, compressing the earth at said rear end, inserting a strip-like layer of a waterproof material under the protection of a cover of the driving shield, constructing and subsequently dismantling a supply tunnel pipe comprised of individual tunnel pipe sections under the protection of said cover while the driving shield is moved forward, and using the dismantled tunnel pipe sections of the one tunnel pipe to erect an additional tunnel pipe which is laterally displaced in direction toward the next strip-like layer opposite said one tunnel pipe behind the driving shield.

2. A method according to claim 1, including pulling the driving shield forward on said one tunnel pipe via hydraulic drives while supporting itself on said additional tunnel pipe,

3. A method according to claim 2, including unwinding a foil strip beside said additional tunnel pipe under the protection of the cover by the forward motion of the driving shield, and welding or bonding the foil with foil sheet already laid in a previous step.

4. A method according to claim 3, including inserting said waterproof layer beside said one tunnel pipe and in front of the driving shield, said layer being run over by the base plate of the driving shield.

5. A method according to claim 4, including conveying excess waste material and sealing material to be inserted in the tunnel pipes.

6. A method according to claim 5, including attaching personnel and/or material sluices at the ends of the tunnel pipes.

7. A method according to claim 6, including laying piping on the layer of the waterproof material for drawing off seepage water to a pumping station and treatment station.

8. Apparatus for installing an underground seal beneath a garbage dump comprising a driving shield for progressively working the earth under the garbage dump in adjacent strips including means for transporting the worked earth to the rear end of the driving shield, means for compressing the transported earth at said rear end, a cover for the driving shield, means for laying a strip-like layer of a waterproof material under the protection of the cover prior to disposing worked earth takeover, and a first tunnel pipe comprised of individual pipe sections located beside the driving shield, and means for dismantling the pipe sections progressively and constructing an additional pipe, using the dismantled pipe, laterally displaced from the first tunnel pipe behind the first tunnel pipe.

9. Apparatus as defined in claim 8 including means for pulling the driving shield forward on said one tunnel pipe via hydraulic drives and for supporting itself on said additional tunnel pipe.

10. Apparatus as defined in claim 9 including means for unwinding a roll of foil strip beside said additional tunnel pipe under protection of said cover as the driving shield moves forward.

11. Apparatus as defined in claim 10 including means for transporting sealing material within said tunnel pipes.

12. Apparatus as defined in claim 11 including personnel and/or material sluices at the ends of the tunnel pipes.

13. Apparatus as defined in claim 11 including drainage pipes for drawing off seepage water disposed on the layer of waterproof material.

14. Apparatus as defined in any one of claims 8–13 in which at least some of the tunnel pipe sections have end profiles extending alternately vertically and diagonally to the pipe axis, in such a way that a bend of the tunnel pipe results when the tunnel pipe sections are turned about their axes.

15. Apparatus as defined in any one of claims 8–13, and further including a clearing device for working the earth beside said one tunnel pipe and in front of the next tunnel pipe.

16. Apparatus as defined in claim 8, and further including a clearing device for working the earth beside said one tunnel pipe and in front of the next tunnel pipe, in which said cover is larger than the base plate.

17. Apparatus as defined in claim 16, further including laterally movable shields for preventing a cave-in.

18. Apparatus as defined in any one of claims 10–15, further comprising a substantially vertical press located at the rear end of the driving shield above said roll of said foil strip having a folding plate, for backfilling and compressing earth behind the driving shield.

19. Apparatus as defined in claim 18, in which the substantially vertical press has a duplicate spaced wall for guiding drainage filter material to the surface of the unwound foil strip.

* * * * *